US009287631B2

(12) United States Patent
Ahn et al.

(10) Patent No.: US 9,287,631 B2
(45) Date of Patent: Mar. 15, 2016

(54) COMPACT ASYMMETRICAL DOUBLE-REFLECTOR ANTENNA

(71) Applicants: Jiho Ahn, Seoul (KR); Elena V Frolova, Seoul (KR)

(72) Inventors: Jiho Ahn, Seoul (KR); Elena V Frolova, Seoul (KR)

(73) Assignee: TELEFRONTIER CO., LTD, Seoul (KR)

( * ) Notice: Subject to any disclaimer, the term of this patent is extended or adjusted under 35 U.S.C. 154(b) by 6 days.

(21) Appl. No.: 14/111,169

(22) PCT Filed: Mar. 22, 2013

(86) PCT No.: PCT/KR2013/002376

§ 371 (c)(1),
(2) Date: Oct. 10, 2013

(87) PCT Pub. No.: WO2013/147460

PCT Pub. Date: Oct. 3, 2013

(65) Prior Publication Data

US 2015/0084820 A1 Mar. 26, 2015

(30) Foreign Application Priority Data

Mar. 26, 2012 (RU) ..... 2012111441
Feb. 12, 2013 (KR) ..... 10-2013-0014969

(51) Int. Cl.

| | |
|---|---|
| ***H01Q 13/00*** | (2006.01) |
| ***H01Q 19/13*** | (2006.01) |
| ***H01Q 13/02*** | (2006.01) |
| ***H01Q 19/17*** | (2006.01) |
| ***H01Q 19/19*** | (2006.01) |
| ***H01Q 15/16*** | (2006.01) |

(52) U.S. Cl.
CPC ..... *H01Q 19/132* (2013.01); *H01Q 13/02* (2013.01); *H01Q 15/167* (2013.01); *H01Q 19/17* (2013.01); *H01Q 19/19* (2013.01)

(58) Field of Classification Search
CPC ... H01Q 19/17; H01Q 15/248; H01Q 19/193; H01Q 19/023
USPC ..... 343/779, 781 P, 781 R, 761, 781 CA
See application file for complete search history.

(56) References Cited

U.S. PATENT DOCUMENTS

| | | | | |
|---|---|---|---|---|
| 2008/0094298 | A1* | 4/2008 | Kralovec et al. ..... | H01Q 19/19 343/781 CA |
| 2012/0013516 | A1* | 1/2012 | Ahn et al. ..... | H01Q 19/19 343/779 |

FOREIGN PATENT DOCUMENTS

| | | |
|---|---|---|
| KR | 10-2005-0091310 | 9/2005 |
| KR | 10-2009-0043082 | 5/2009 |
| KR | 10-2012-0019194 | 3/2012 |

*Primary Examiner* — Dameon E Levi
*Assistant Examiner* — Collin Dawkins
(74) *Attorney, Agent, or Firm* — John K. Park; Park Law Firm

(57) ABSTRACT

The antenna comprises main and sub reflectors, each of which being made with nonaxisymmetric curvilinear surfaces and having two planes of symmetry at the intersection. A feed is arranged between the main and sub reflectors and capable of illuminating, first, the sub-reflector and, through it, the main reflector to form plane wave front. The common focuses of the nonaxisymmetric curvilinear surfaces of the reflectors in all sections passing through the longitudinal axis Z of the antenna, is located at the portion $Z_0$ of Z, wherein the length of said portion being restricted by limits $F_{min} \leq Z_0 \leq F_{max}$, where $F_{min}$, $F_{max}$ are the minimum and maximum distances from the ends of the portion $Z_0$ to the main reflector along Z. The length of $Z_0$ satisfies the following relation; $F_{min}/D_{max} \leq Z_o/D_{max} \leq F_{max}/D_{max}$ and $0.21 \leq Z_o/D_{max} \leq 0.47$, $1 > D_{min}/D_{max} > 0.5$, where $D_{max}$ and $D_{min}$ are the maximum and minimum transverse sizes of the main reflector aperture.

22 Claims, 7 Drawing Sheets

COMPACT ASYMMETRICAL DOUBLE-REFLECTOR ANTENNA

FIELD OF THE INVENTION

The present invention relates generally to radio engineering, and in particular, to double-reflector antennas, which may be used in communication and satellite television systems.

DESCRIPTION OF THE PRIOR ART

The multiple-beam reflector antennas suitable for simultaneous reception of signals from several satellites are required. One such development focuses on maintaining the satisfactory electrical properties of antenna, while reducing the size of the reflectors. Compactness in the longitudinal (axial) direction is achieved in the double-reflector systems of Cassegrain, Schwarzschild and antennas made according to the Axially Displaced Ellipse (ADE) configuration. The reflector surfaces in these systems are, mostly, the rotational surfaces or cuttings from axial-symmetric surfaces. The utilization of symmetric surfaces limits the capacities of double-reflector systems. In an axial symmetrical system, if the feed has axially-symmetric radiation, then the main reflector also forms a beam with circular symmetry. The formation of non-axisymmetric beams or elliptic cross-section beams in an antenna system is required. This type of system is required when antennas simultaneously receive signals from satellites located in orbits with a small spacing at an azimuth angle of several degrees. In order to target the satellites exactly, the large dimensions at azimuth plane of the main reflector is needed to have narrow main beams. When forming beams with an elliptic cross-section, it is possible to reduce one of the reflector transverse dimensions in a plane where the narrow beam width is not required (in the plane of elevation angles), while maintaining the narrow beam width in the azimuth plane.

Most existing reflector systems have either good scanning characteristics or axial compactness, but not both.

A Cassegrainian multiple-beam antenna is known (U.S. Pat. No. 3,914,768), where the main reflector and the sub-reflector comprise the cut part from the surfaces of revolution, a paraboloid and a hyperboloid, respectively, around the system's main axis. Several feeds are arranged along the spatial focal curve. In order to avoid radiation blockage by the sub-reflector, an offset design is utilized. A disadvantage of this antenna is its great length, and consequently, a high H/D value (axial size H to diameter D ratio of the main reflector), which characterizes non-compact antenna.

A compact multiple-beam double-reflector antenna, which comprises a main reflector (ADE) and several truncated sub-reflectors forming multiple beams, is known (KR 10-944216).

A disadvantage of this antenna is the symmetry of the main reflector, as well as the difficulty of realizing closely located beams due to the fact that a major part of the sub-reflectors is truncated (overlapped) too much, which results in decreased antenna aperture efficiency.

A compact double-reflector antenna made according to the ADE design is known (US 2008/0094298). The main reflector and the sub-reflector of this antenna have nonaxisymmetric surfaces; they are not surfaces of revolution. When forming the main reflector surface, the generatrix of the main surface, i.e., a parabola with an offset axis, and the generatrix of the sub-reflector, i.e., an ellipse with an inclined axis, are changed when rotated by 360°. A special horn with an asymmetrical aperture is utilized as a feed. The horn together with the sub-reflector form, similar to a circular focus of a general ADE antenna, has an elliptical focus. A system of asymmetrical reflectors allows for creation of a narrow beam with an arbitrary section. A disadvantage of this antenna is its single beam, since it is well known that many of ADE systems has poor scanning properties, i.e., the antenna aperture efficiency sharply falls when the feed is displaced out of focus.

SUMMARY OF THE INVENTION

The objective of the invention is to improve antenna performance of low profile and expand antenna functionality.

The technical effect, which may be achieved by the claimed device, is improving compactness and increasing antenna gain.

An another technical effect of the invention is an increase in the reception number of satellites by using antenna of narrower beam width at the azimuth plane, while its dimensions, in the longitudinal direction is compact (low profile), and its dimension on vertical plane are reduced with its dimension on horizontal plane being same to have a narrower beam width, which thereby eliminates the reception of unwanted signals and leads to be or look smaller suitable to the market and enables the antenna of greater efficiency to precisely target closely-located multiple satellites. Those facts of improving total compactness are on the contrary to the property of axial symmetric antenna.

In accordance with the present invention, a double-reflector antenna comprises a main reflector and a sub-reflector, each of which being made with nonaxisymmetric curvilinear surfaces and having two symmetry planes at which intersection a longitudinal axis Z is located, and at least a feed arranged between the main reflector and the sub-reflector with the capacity of illuminating, first, the sub-reflector and then, through it, the main reflector to allow for a plane wavefront, and the common focuses of the nonaxisymmetric curvilinear surfaces of the main reflector and the sub-reflector in all sections pass through the longitudinal axis Z of the antenna, and the sub-reflector faces the main reflector in a convex shape along the longitudinal axis Z, and the generatrix of the nonaxisymmetric curvilinear surfaces of the sub-reflector is defined in spherical coordinates $r(\theta,\phi)$ as:

$$r(\theta, \varphi) = \frac{r(0.0)}{P_m(\theta, \varphi)},$$

Where $P_m(\theta,\phi)$—a polynomial of m-degree, and $\theta$, $\phi$—angles in spherical coordinates, and the relation $I=H/D_{max}$ can be realized within the limits of $0.24<I<0.35$, where H is the antenna maximum size along the longitudinal axis Z, and $D_{max}$ is the maximum transverse size of the main reflector aperture.

Further:

the common focuses can be located at the portion $Z_0$ of the longitudinal axis Z, wherein the length of the said portion can defined by the followings.

$$F_{min} \le Z_0 \le F_{max},$$

$$F_{min}/D_{max} \le Z_o/D_{max} \le F_{max}/D_{max}$$

$$0.21 \le Z_o/D_{max} \le 0.47$$

$$1 > D_{min}/D_{max} > 0.5,$$

where $Z_0$ is the portion of common focuses located along the longitudinal axis Z, $F_{min}$, $F_{max}$ are the minimum and maximum distances from the ends of the portion $Z_0$ to the main reflector along the longitudinal axis Z, $D_{max}$, $D_{min}$ is the maximum and minimum transverse size of the main reflector aperture.

Further:

Sections of nonaxisymmetric curvilinear surfaces of the sub-reflector in the symmetry planes can be hyperbolic curves.

Further:

Sections of nonaxisymmetric curvilinear surfaces of the main reflector in the symmetry planes can be parabolic curves and sections of nonaxisymmetric curvilinear surfaces of the sub-reflector in the symmetry planes can be hyperbolic curves.

Further:

Sections of nonaxisymmetric curvilinear surfaces of the main reflector and the sub-reflector in the symmetry planes can be aplanatic curves of the Schwarzschild's system with different focal radii.

Further:

The main reflector can have its edge in a projection to the plane perpendicular to the antenna longitudinal axis Z, which is in the form of an ellipse.

Further:

The main reflector can have its edge in a projection to the plane perpendicular to the antenna longitudinal axis Z, which is in the form of a polygon circumscribing around an ellipse.

Further:

The main reflector can have its edge in a projection to the plane perpendicular to the antenna longitudinal axis Z, which is in the form of an ellipse truncated by two planes parallel to a symmetry plane passing through the maximum transverse size of the main reflector aperture.

Further for each of the followings:

The feed can be made as at least one horn which axis is parallel or inclined to the antenna longitudinal axis Z, and the horn phase center is aligned with the sub-reflector focal line;

The horn can have a symmetrical directional beam;

The horn can have an asymmetrical directional beam;

Further for each of the followings:

The feed can be made of at least two horns located at a focal curve passing through the sub-reflector focus, which axes are inclined relatively to the antenna longitudinal axis Z;

The feed can be made as a single assembly of at least two horns which axes are parallel to the antenna longitudinal axis Z, and the adjacent walls can be truncated or not truncated.

In the last two embodiments, each of the horns may have a symmetrical directional beam or an asymmetrical directional beam.

The above advantages as well as the features of this invention will be explained below with reference to the accompanying figures.

DETAILED DESCRIPTION OF EMBODIMENTS OF THE INVENTION

The double-reflector antenna (FIGS. 1-4) comprises a main reflector 1 and a sub-reflector 2, each of them being made with nonaxisymmetric curvilinear surfaces and each having two planes of symmetry, at the intersection of which a longitudinal axis Z is located. A feed 3 is arranged between the main reflector 1 and the sub-reflector 2 and is capable of illuminating the sub-reflector 2 first and through it, the main reflector 1, in order to provide formation of plane wave front. The sub-reflector faces the main reflector in a convex shape along the longitudinal axis Z, which is not sharp, and the generatrix of the nonaxisymmetric curvilinear surface of the sub-reflector can be defined in spherical coordinates $r(\theta,\phi)$ (FIG. 1-4) as:

$$r(\theta, \varphi) = \frac{r(0, 0)}{P_m(\theta, \varphi)}$$

($P_m(\theta,\phi)$—a polynomial of m-degree, and $\theta$, $\phi$—angles in spherical coordinates).

Figure 1:
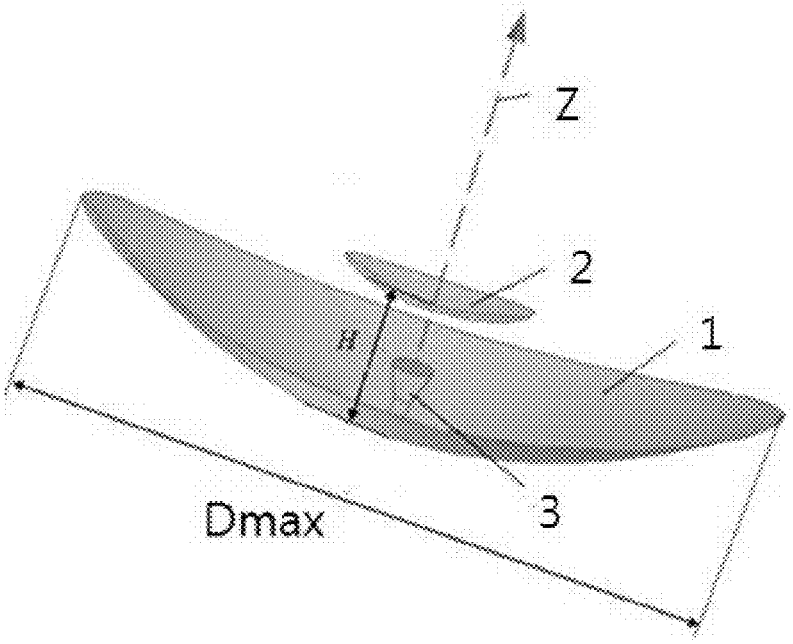
FIG. 1 shows a general view of the reflector surfaces for the antenna according to an embodiment of the invention.
Figure 2:
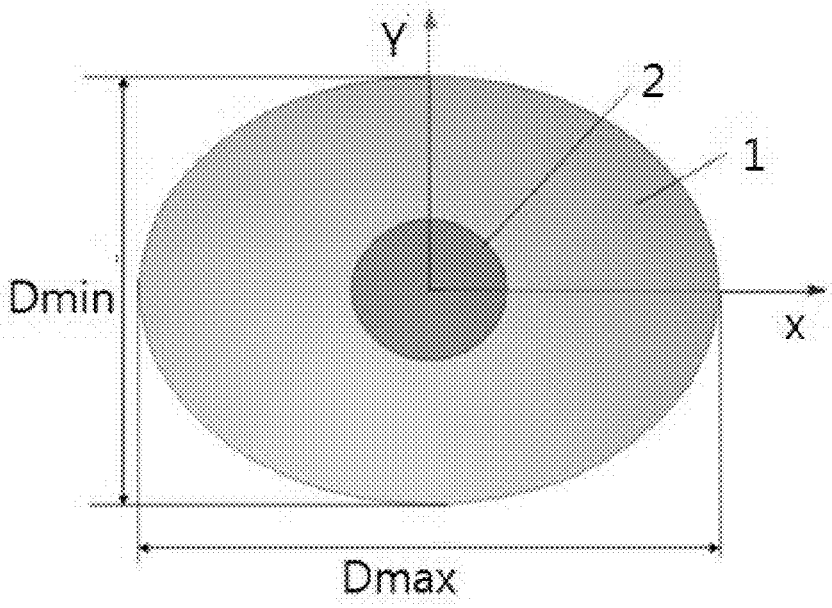
FIG. 2 shows a front view of the main reflector and the sub-reflector as seen from the OZ longitudinal axis.
Figure 3:
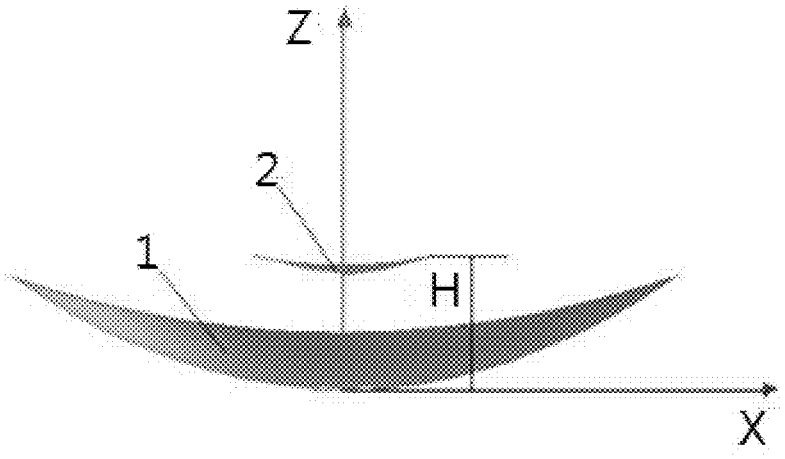
FIG. 3 shows a view of the main reflector and the sub-reflector in one of symmetry planes, namely, in the ZX azimuth plane.
Figure 4:
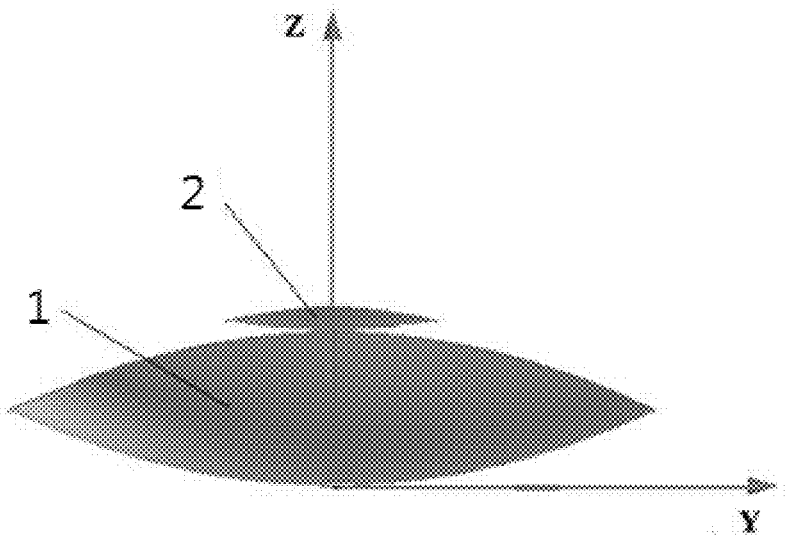
FIG. 4 shows a view of the main reflector and the sub-reflector of FIG. 3, in the ZY plane.

The relation $I=H/D_{max}$ (H is the antenna maximum size along the longitudinal axis Z, and $D_{max}$ is the maximum transverse size of the main reflector aperture) is realized within the limits of $0.24<I<0.35$ (FIG. 1).

Figure 5:
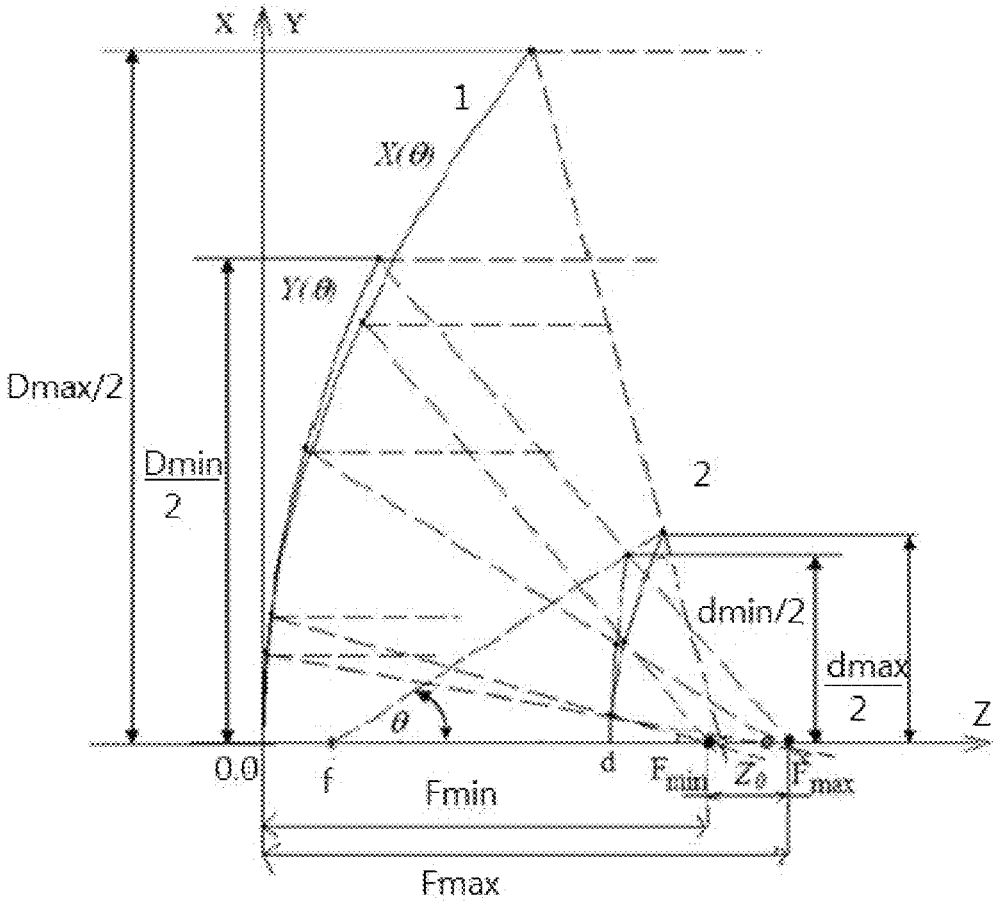
FIG. 5 shows the generatrices of the main reflector and the sub-reflector in the XZ, YZ symmetry planes and the beam paths when the horn is located in the focus f of the sub-reflector according to an embodiment of the invention.
Figure 6:
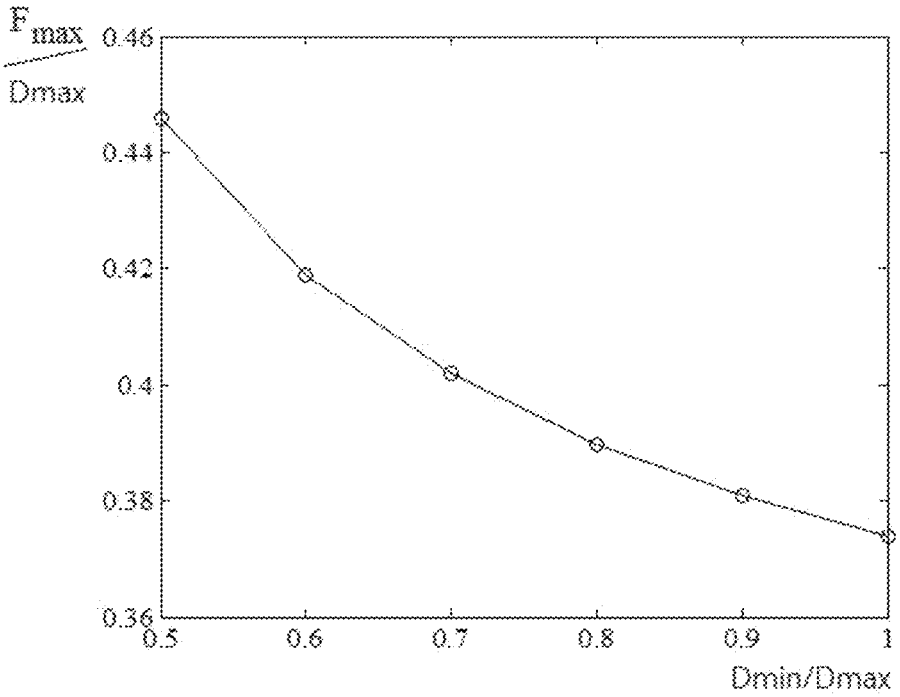
FIG. 6 shows the dependence of the boundary of the $Z_0$ portion of focal area on asymmetry parameters of the main reflector according to an embodiment of the invention.

The common focus of the nonaxisymmetric curvilinear surfaces of the main reflector 1 and the sub-reflector 2 in all sections passing through the longitudinal axis Z is located on the portion $Z_0$ of the longitudinal axis Z (FIG. 5). The length of the portion $Z_0$ is restricted by limits $F_{min} \leq Z_0 \leq F_{max}$, where $F_{min}$, $F_{max}$ are the minimum and maximum distances from the ends of the portion $Z_0$ to the main reflector 1 along the longitudinal axis Z. The length of the portion $Z_0$ satisfies the relation $F_{min}/D_{max} \leq Z_o/D_{max} \leq F_{max}/D_{max}$, $0.21 \leq Z_o/D_{max} \leq 0.47$, $1 > D_{min}/D_{max} > 0.5$ where $D_{max}$ is the maximum transverse size of the aperture of the main reflector 1, and $D_{min}$ is the minimum transverse size of the main reflector 1. In FIG. 5, $d_{min}$ is the minimum transverse size of the aperture of the sub-reflector 2, and $d_{max}$ is its maximum transverse size.

Sections of nonaxisymmetric curvilinear surfaces of the main reflector 1 and the sub-reflector 2 in the symmetry planes can be aplanatic curves of the Schwarzschild's system with different focal radii.

Figure 7:
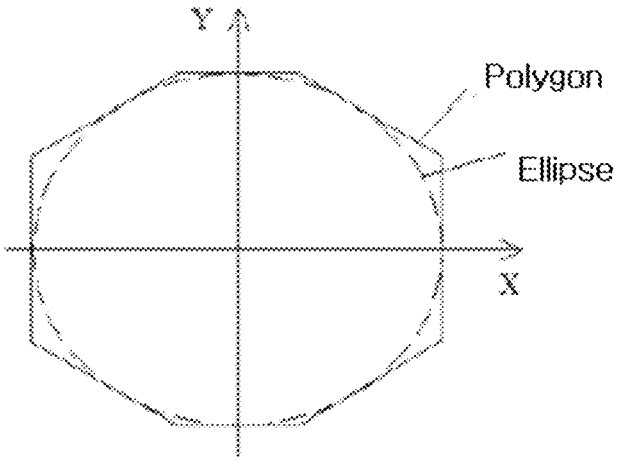
FIG. 7 shows the main reflector having its edge in a projection to the plane perpendicular to the antenna longitudinal axis Z, which is in the form of an ellipse (shown by a dashed line) and in the form of a polygon circumscribing around the said ellipse (shown by a solid line)

The main reflector 1 may have its edge in a projection to the plane perpendicular to the antenna longitudinal axis Z, which is in the form of an ellipse (shown in FIG. 7 by a dashed line).

The main reflector 1 may have its edge in a projection to the plane perpendicular to the antenna longitudinal axis Z, which is in the form of a polygon circumscribed around an ellipse (shown in FIG. 7 by a solid line).

Figure 8:
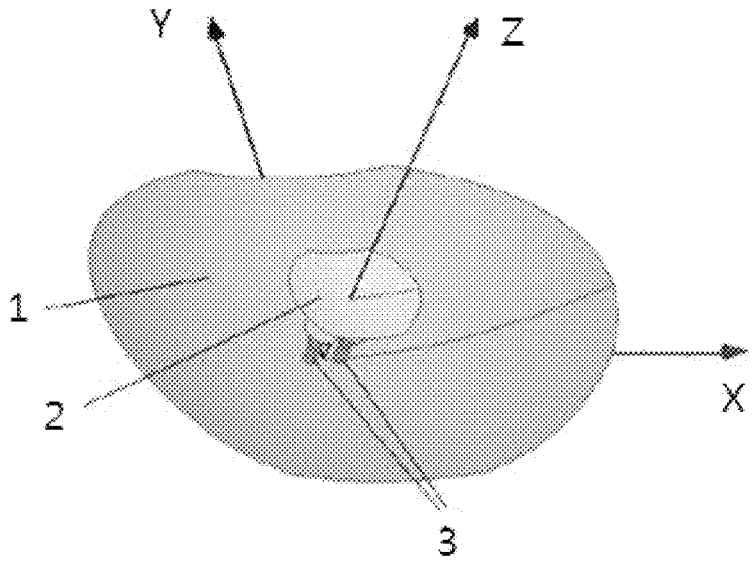
FIG. 8 shows the main reflector having its edge in the form of an ellipse truncated by two planes parallel to a symmetry plane passing through the maximum transverse size of the main reflector aperture.

The main reflector 1 may have its edge in a projection to the plane perpendicular to the antenna longitudinal axis Z, which is in the form of an ellipse truncated by two planes parallel to a symmetry plane passing through the maximum transverse size of the aperture of the main reflector 1 (FIG. 8).

The feed 3 may be made as a single horn (FIG. 1, 9) which axis is parallel to the antenna longitudinal axis Z, and the horn phase center is aligned with focus f of the sub-reflector 2 (FIG. 5).

Figure 10:
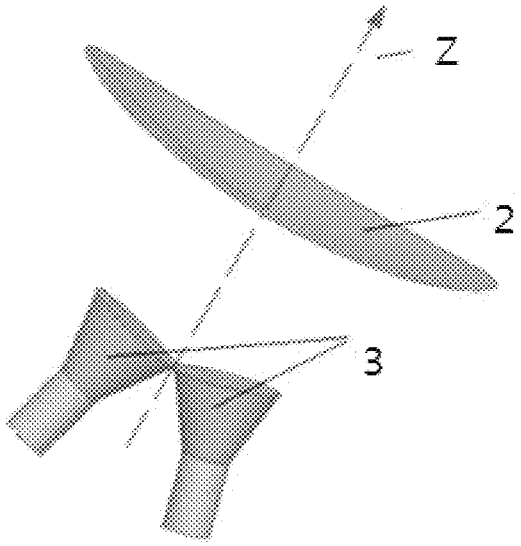
FIG. 10 shows the feed made of two horns which axes are inclined relatively to the antenna longitudinal axis Z.

The feed 3 may be made of at least two horns located at a focal curve passing through the sub-reflector focus, which axes are inclined relatively to the antenna longitudinal axis Z (FIG. 10).

Figure 11:
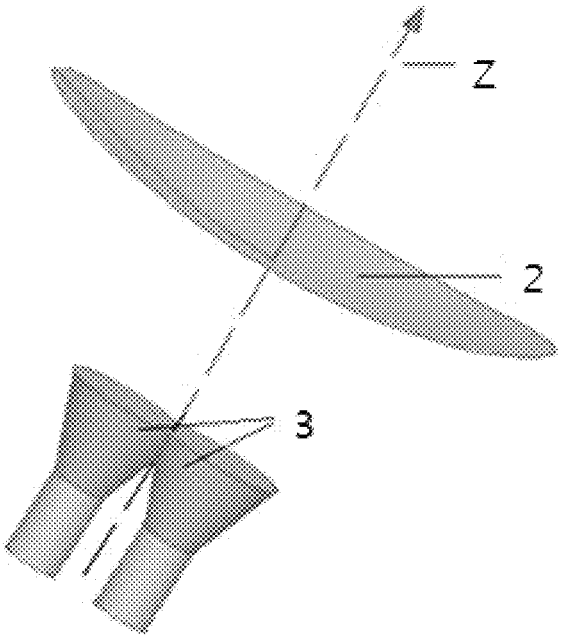
FIG. 11 shows the feed made in the form of a single assembly consisting of two horns which adjacent walls are truncated to be mated.

Furthermore, the feed 3 is made as a single assembly of two horns which axes are parallel to the antenna longitudinal axis Z, and the adjacent walls are truncated (FIG. 11).

Figure 9:
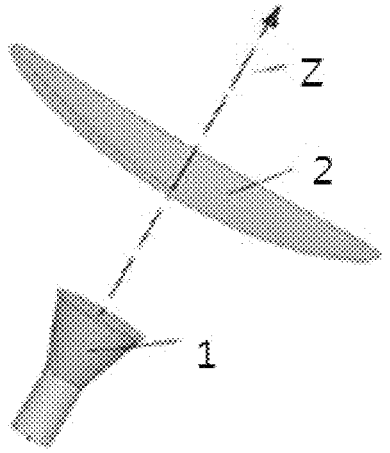
FIG. 9 shows the feed made as a single horn.

The horns (FIGS. 9, 10, 11) may have a symmetrical directional beam or an asymmetrical directional beam.

It is understood that other embodiments may be utilized and structural changes may be made without departing from the scope of the present invention.

The double-reflector antenna (FIGS. 1-5) works as follows.

When being illuminated by the feed 3 made as a single horn (FIGS. 1, 5, 9), which axis is parallel to the longitudinal (main) axis Z of the antenna, the horn phase center is aligned with the focus f of the sub-reflector 2 (FIG. 5), and the sub-reflector 2 re-reflects the illumination to the main reflector 1. There, with variable curvature of the reflector surfaces, the horn axial-symmetric radiation is transformed into nonaxisymmetric radiation of the main reflector 1. A selection of generatrices for the main reflector 1 and the sub-reflector 2, which do not have a common focal point, contrary to curves of the second order (for example, a parabola and a hyperbola), can be more advantageous for optimizing the antenna parameters. When optimizing the single-beam operation mode, generatrices can be created to realize amplitude distribution on the main reflector, which distribution ensures a minimum level of radiation blockage by the sub-reflector 2.

When the horn is displaced from the focal point of the sub-reflector 2 orthogonally to the longitudinal axis Z, a beam deviates from the axial direction. If several horns are arranged in the focal surface of the sub-reflector 2, several multiple beams are formed. A form of generatrices for the reflectors in the case of multiple beam mode is selected for the maximum antenna aperture efficiency of each beam with each given directions. In this case, generatrices are optimized to ensure a compromise between levels of amplitude and phase aberrations and a level of sub-reflector blockage.

Both in the case of the single-beam operation mode, and in the case of the multiple-beam operation mode, arrangement of a common focal point for nonaxisymmetric curvilinear surfaces in all their sections passing through the longitudinal axis Z at the portion $Z_0$ of the longitudinal axis Z (FIG. 5) ensures compactness of the antenna in the longitudinal direction. When a length of the portion $Z_0$ can be selected so as to satisfy the following relationship $$F_{min}/D_{max} \leq Z_o/D_{max} \leq F_{max}/D_{max}, 0.21 \leq Z_o/D_{max} \leq 0.47,$$

and the main reflector asymmetry parameter is changed in the range of $1 > D_{min}/D_{max} > 0.5$, the relation $I = H/D_{max}$ can be realized within $0.24 < I < 0.35$ (where H is the maximum antenna size along the longitudinal axis Z, and $D_{max}$ is the maximum transverse size of the main reflector aperture). Further, when the distance of the highest edges along the longitudinal axis Z between the main reflector and sub-reflector is 10~20 mm, $0.27 \leq Z_o/D_{max} \leq 0.35$ can be applied.

Thus, one of the unique features in the present invention can be the location range of the common focal point for the sub-reflector 2 and the main reflector 1 on the portion $Z_0$ for the compact antenna in the longitudinal Z axis regardless of its single beam or multiple beam mode. As a result of the location of focal points, their nonaxisymmetric curvilinear surfaces can be changed and they can differ from the respective surfaces of analogous solutions and can be optimized by different ways while the formation of a plane wave front at the output of the antenna system is optimally ensured.

The use of a polynomial form for circumscribing nonaxisymmetric surfaces can have an additional advantage when creating surfaces for an antenna with optimal scanning characteristics for forming several multiple beams. Polynomial coefficients and, consequently, the reflector surface parameters, the law of correspondence, mutual arrangement of the main reflector, the sub-reflector and the illuminating system are defined for the optimization both for the maximal antenna aperture efficiency of one or at least two multiple beams and for minimum dimensions of an antenna in the longitudinal and transverse directions.

The invention is based on the following background and considerations.

Known multiple-beam and scanning antennas comprise the main reflector being a cutting from a surface of revolution—either axial-symmetric or toroidal. And, if a projection of the reflector edge on the elliptical aperture plane is required, a horn (or horns) of a feed having symmetric radiation in each particular position illuminates only a part of the surface of the main reflector 1. This invention utilizes nonaxisymmetric surfaces that are able to transform (either compress, or spread out) a beam (or beams) of the feed 3 in one of the transverse directions. By presetting an asymmetry coefficient for the aperture of the main reflector 1 at $D_{min}/D_{max}$, it becomes possible to create nonaxisymmetric surfaces for a double-reflector antenna system, that enable to transform beam of the horn(s) for the feed 3 (either symmetric, or asymmetric) into a narrow beam with an elliptic section and required angular characteristics without losing efficiency. Such surfaces may be realized on the basis of the classic double-reflector designs of Cassegrain or Gregory as well as aplanatic systems, using their generatrices in two planes of symmetry of created nonaxisymmetric surfaces.

The most compact axial-symmetric antennas in the axial direction are the Cassegrainian system and the Schwarzschild's aplanatic system. The best scanning properties, when a feed is displaced from the focus, are those of the Schwarzschild's system. The double-reflector systems of an offset type can have the fewest losses caused by sub-reflector blockage. A disadvantage of offset designs, however, is a great H/D relation, where H is the size of a double-reflector antenna relatively to the longitudinal axis Z, and D is a diameter of the main reflector 1. Hence, It would be expected that optimal electric and dimensional characteristics, when one or several multiple beams are formed, can be those of double-reflector nonaxisymmetric systems having two planes of symmetry and having generatrices with aplanatic properties in these planes, which aplanatic properties can ensure minimum beam aberration when the feed 3 is displaced out of the focus f (FIG. 5).

The claimed technical solution proposes the following.

In a double-reflector antenna intended for simultaneous reception of signals from several satellites, nonaxisymmetric surfaces of the reflector can provides the transformation of beams of axial-symmetric feeds into narrow beams in the azimuth plane of the main reflector 1 with preset parameters of asymmetry. Further, with preset values of an antenna gain and directions of multiple main lobes, the form of generatrices in the reflector planes of symmetry, the law of changing the generatrix curvatures in intermediate planes, a position of the sub-reflector 2 relative to the main reflector 1 can be selected for the maximum antenna aperture efficiency of beams deflected from the central position and for its low profile (compactness) on the longitudinal Z axis direction.

The edge of the main reflector 1 in the claimed double-reflector antenna is non planar and has an elliptic form of projection to a plane perpendicular to the longitudinal axis Z (FIG. 7). This edge can be made in the form of a polygon circumscribed around an ellipse (shown by a solid line in FIG. 7). The main reflector 1 can have the edge in a projection to a plane, which is perpendicular to the antenna longitudinal axis Z, in the form of an ellipse truncated by two planes parallel to a plane of symmetry passing through the maximum transverse size of the main reflector 1 (FIG. 8). This case can be realized in a multiple-beam variant of the antenna when it is necessary to expand the sub-reflector on one side in a direction of scanning and to diminish the sub-reflector on the other side for reducing the blockage level.

FIGS. 1, 8-11 show embodiments of the feed 3. In the single-beam operation mode a feed in the form of a single axial-symmetric horn (FIG. 9) is used, which is located on the longitudinal axis Z, the horn phase center being aligned with the focus of the sub-reflector 2.

In the double-beam operation mode, a pair of horns are used, which are arranged symmetrically relative to the longitudinal axis Z. In this case two embodiments of the feed 3 are possible. In the first case (FIG. 10) the horn phase centers lie on a focal curve passing through the focus of the sub-reflector 2, and the horn axes are inclined relative to the axis Z. By selecting coordinates of the phase centers and inclination angles for the horns, a maximum antenna aperture efficiency may be achieved in the result of optimization for given directions of multiple beams. In the second case the feed 3 can be made as a single assembly of the two horns which axes are parallel to the antenna longitudinal axis Z, and the adjacent walls are truncated (FIG. 11). In the latter case a standard two-channel LNB block (Multi Low-Noise Block) can have a fixed distance between the axes of the truncated horns. Directivity radiation of horns with truncated walls, which form a single block, are different from axial-symmetric ones. In this case, the form of the reflector edges can be optimized, when electromagnetic field level lines induced on the reflector surfaces are being considered.

The form of the surface of the sub-reflector can be derived from the following equation:

$$r(\theta, \varphi) = \frac{r(0, 0)}{1 - P_m(\theta, \varphi)},$$

where $r(\theta,\phi=0)$, $r(\theta,\phi=90°)$ are generatrices of the sub-reflector 2 in the planes of symmetry, and $\theta,\phi$ are angular coordinates;

$P_m(\theta,\phi)$ is a polynomial in m degree, comprising even degrees of the variable $\theta$:

$$P_m(\theta,\phi)=a_2(\phi)\theta^2+a_4(\phi)\theta^4+a_6(\phi)\theta^6+\ldots+a_m(\phi)\theta^m,$$

where coefficients $a_m$ are periodic functions of the variable $\phi$.

There exists interrelation between coefficients $a_m$ of a polynomial and the two-dimensional law of correspondence of the feed 3 and the main reflector 1.

Coefficients $a_m$ of the polynomial $P_m(\theta,\phi)$ and, hence, parameters of curvilinear nonaxisymmetric surfaces of the reflectors, the law of correspondence, mutual arrangement of the system feed 3, the main reflector 1 and the sub-reflector 2, can be determined for optimizing the two requirements: maximum antenna aperture efficiency for one or at least two multiple beams and the compact, low profile antenna, as it is described below.

Figure 12:
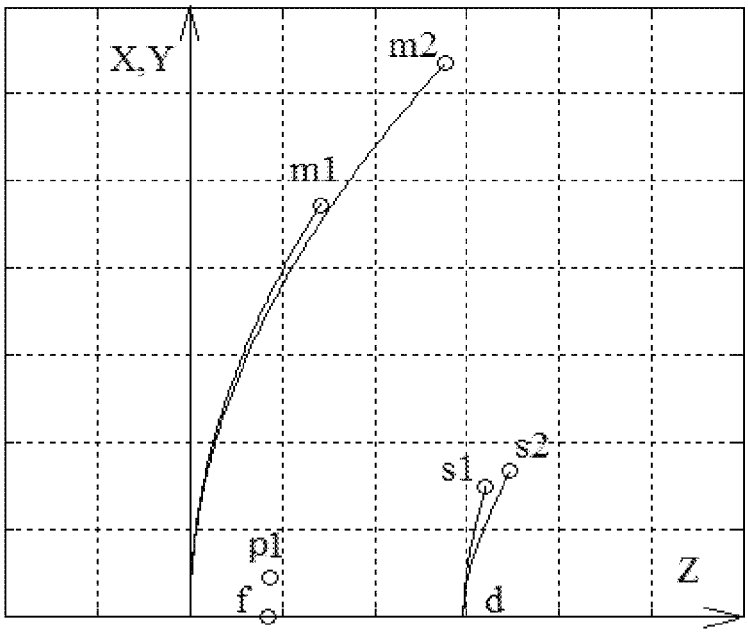
FIG. 12 shows typical points of generatrices planes of the main reflector and the sub-reflector in one of the antenna embodiments.

FIG. 5 shows the reflector generatrices in the planes of symmetry XZ and YZ. In accordance with laws of the geometric optics, beams illuminating from the focus f on the system axis at angles $\theta$ cross the generatrices of the sub-reflector 2 (FIG. 12) in points s1, s2 and the generatrices of the main reflector 1 in points m1, m2 form a plane wave front. Since the reflector surfaces are not planes of revolution and possess only two planes of symmetry, laws of correspondence between beams in these planes $x=x(\theta)$ and $y=y(\theta)$ are different (here, x, y are the coordinates at which beams cross the surface of the main reflector 1). In this result, a circular cone of beams is transformed into a quasi-elliptic cylinder, rather than into a circular cylinder as in an axial-symmetric system. Furthermore, if the feed 3 is displaced from the focus f in the antenna focal plane, a radiation front of the main reflector 1 rotates by the displaced angle. In accordance with physical optics, the antenna transforms axial-symmetric illumination from a source into a nonaxisymmetric beam of the main reflector 1. The generatrices of the main reflector 1 and the sub-reflector 2, in at least the azimuth plane (XZ), can be made as curves, close to aplanatic one. The form of the curvilinear surface of the sub-reflector 2 can be made smooth and convex. This provides good scanning properties, i.e., if several horns of the feed 3 are arranged in the focal plane (or on the focal curve) of the antenna, several beams are formed, respectively. In order to reduce amplitude aberrations when the horns of feed 3 which are displaced out of the focus f partially illuminate sub-reflector 2, it is possible to optimize the position of the phase center and the axis inclination for the horns of feed 3 (FIG. 10).

If a double horn (FIG. 11), which is made as a single assembly of horns which axes are parallel to the antenna's longitudinal axis Z, is used and the adjacent walls are truncated to be mated, then it is necessary to expand (elongate) sub-reflector 2 in the scanning plane (XZ) by adding extra portions of a curvilinear surface. In that way, the spillover can be avoided in each direction corresponding to the displacement of feeds.

It can be realized as follows. First, sub-reflector 2 is created for a greater angular dimension of reflector $\theta_m > \theta_o$. Then the sub-reflector surface is truncated by two planes $Z = \pm Z_p$ (FIG. 8). The values $\theta_m$ and $Z_p$ then become optimization parameters. Main reflector 1 is also made as a portion of a curvilinear nonaxisymmetric surface created with a reserve. The form of an aperture obtained as a result of cutting, can be different, e.g., in the form of a truncated ellipse, a polygon, etc. Also the antenna gain may be further increased, depending on design requirements of the reflector edge.

$$X = 2(d-f)\frac{F(\varphi)}{F(\varphi)-d}tg\frac{\theta}{2}\cos\varphi,$$

$$Y = 2(d-f)\frac{F(\varphi)}{F(\varphi)-d}tg\frac{\theta}{2}\sin\varphi,$$

$$Z = F(\varphi)\left(\frac{d-f}{F(\varphi)-d}\right)^2 tg^2\frac{\theta}{2},$$

$$x = r(\theta,\varphi)\sin\theta\cos\varphi,$$

$$y = r(\theta,\varphi)\sin\theta\sin\varphi,$$

$$z = f + r(\theta,\varphi)\cos\theta.$$

2) For the law of correspondence $x = h_1 \sin\theta$ and $y = h_2 \sin\theta$, which characterizes pairs of aplanatic generatrices of the Schwarzschild's system, a particular case of the polynomial $P_m(\theta,\phi)$ can be as follows:

$$P_6(\theta,\varphi) = \frac{1}{4}\left(\frac{f+f_1}{d}\theta^2 - 0.0417\frac{2f+5f_1}{d}\theta^4 + 0.0007\frac{19f_1 d + 4df - 15f_1^2}{d^2}\theta^6\right)$$

Variants of the known laws of correspondence are possible when constructing asymmetric curvilinear surfaces of the reflectors.

1) For the law $x = h_1 tg\theta/2$ and $y = h_2 tg\theta/2$ that characterizes pairs of generatrices "parabola-hyperbola" for the reflectors, where $h_1 = h(\phi=0)$, $h_2 = h(\phi=90°)$–constants of the correspondence law $$h = 2F\frac{1+\varepsilon}{1-\varepsilon},$$

a particular case of the polynomial $P_m(\theta,\phi)$ can be as follows:

$$P_6(\theta+\varphi) = \frac{\varepsilon(\varphi)}{2(\varepsilon(\varphi)-1)}(\theta^2 - 0.0083\theta^4 + 0.0028\theta^6)$$

where $\epsilon$ is variable eccentricity of a hyperbola, which is associated with a variable value of the parabola focus F (common with hyperbola also) through the relation $$\frac{2\varepsilon}{(\varepsilon-1)} = \frac{F-f}{F-d},$$

where f is a distance from the top of the main reflector 1 (coordinates 0,0 in FIG. 5) to the focus of the sub-reflector 2, d is a distance between the main reflector and the sub-reflector along the longitudinal axis.

Values of the common focus F are different in the symmetry planes. The Cartesian coordinates of the asymmetric curvilinear surfaces of the main reflector 1 (X, Y, Z) and the sub-reflector 2 (x, y, z), when this law is realized, can be as follows:

where $f_1$ is a variable focal radius comprised in the condition of the Abbe "sines", which is equal to the constants of the law of correspondence $h_1$ and $h_2$ in the symmetry planes.

Furthermore, one of the reflector surfaces, e.g., that of the sub-reflector 2, can be preset in accordance with the above formulae, and the form of the main reflector 1 can be determined from the condition of forming a plane wave front by using the procedure of beam tracings, and vice versa.

An Example of Particular Implementation of the Invention in the Form of Double-Beam Antenna For preset deviation of multi beams (±2.15° off the central position) the horns of the feed 3 are arranged in the azimuth plane symmetrically relative to the antenna longitudinal axis Z, with the horn axes being parallel to the axis Z. The surface of the sub-reflector 2 is created with the use of the polynomial $P_6(\theta,\phi)$. Values of the polynomial coefficients, which are derived from the result of multiparametric optimization for the purpose of obtaining a maximum antenna aperture efficiency of multiple beams at a given ellipticity coefficient of the main reflector 1 and a given limitation to a longitudinal size of the antenna are shown in Table 1.

TABLE 1

| | Polynomial Coefficients $a_m$ | | |
|---|---|---|---|
| | $a_2$ | $a_4$ | $a_6$ |
| $\phi = 0$ | 1.0693 | −0.2139 | −0.0282 |
| $\phi = 90°$ | 0.8193 | −0.1618 | −0.0133 |

The positions of both the reflectors and the feed are characterized by the following parameters (here and below all the parameters are given in millimeters): a distance between the reflectors d=148, a distance from the top of the main reflector to the focus f of the sub-reflector 2 on the system axis f=42. The main reflector 1 has transverse dimensions in two planes with a ratio of about 3:4: the equivalent dimensions of an axial-symmetric reflector with an equal surface are 550. The ratio between the maximum longitudinal dimension H to the maximum diameter $D_{max}$, which characterizes the antenna compactness in the axial direction, $H/D_{max}=0.27$.

The coordinates of typical points (FIG. 12) of the reflector generatrices in the symmetry planes XZ and YZ and the positions of the horn phase centers p1 and p2 are shown in Table 2.

TABLE 2

| | m1 | m2 | s1 | d | p1 | p2 |
|---|---|---|---|---|---|---|
| z | 70.8 | 138.4 | 160.3 | 148 | 42.5 | 42.5 |
| x | 0 | 317.5 | 0 | 0 | 22.2 | −22.2 |
| y | 236.4 | 0 | 74.2 | 0 | 0 | 0 |

A view of this embodiment of an antenna with the main reflector aperture in the form of a truncated ellipse is shown in FIG. 8.

Figure 13:
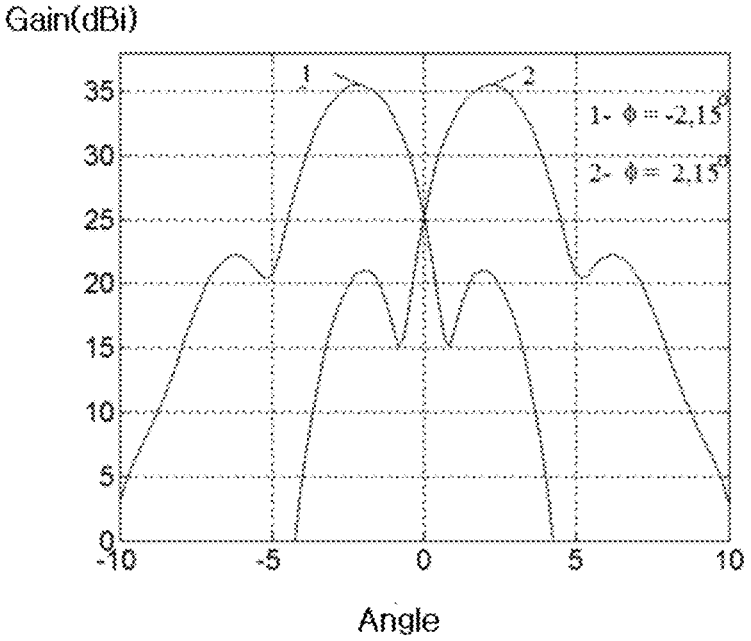
FIG. 13 shows radiation pattern of multiple beams in the azimuth plane for an embodiment of a double-beam antenna.

The antenna parameters are obtained during optimization of antenna aperture efficiency of the main reflector for two beams ±2.15°. The calculations were made by a method of physical optics (PO). As an example of the feed 3, two axial-symmetric scalar horns can have beam width of 65° at the level of −10 dB. The calculated radiation pattern of multiple beams ±2.15° in the azimuth plane is shown in FIG. 13. As the calculations show, the antenna aperture efficiency for the central position of a beam, with the above parameters and with the aperture edge in the form of an ellipse, is 4% higher than that of an axial-symmetric Cassegrainian system with a surface area equal to the main reflector aperture.

In order to obtain several beams (three or more) in an antenna with nonaxisymmetric reflectors, it is advisable to increase the dimensions of a sub-reflector 2 in the azimuth plane. In order to reduce shading (blockage) of the sub-reflector, it is necessary to increase the diameter of the main reflector.

INDUSTRIAL APPLICABILITY

The invention can be useful for an increase in the reception number of satellites by using antenna of narrower beam width at the azimuth plane, while its dimensions, in the longitudinal direction is compact (low profile), and its dimension on vertical plane are reduced with its dimension on horizontal plane being same to have a narrower beam width, which thereby eliminates the reception of unwanted signals and leads to be or look smaller suitable to the customer demand and enables the antenna of greater efficiency to precisely target closely-located multiple satellites.

What is claimed is:

1. A double-reflector antenna comprising:

a main reflector and a sub-reflector, each of which being made with nonaxisymmetric curvilinear surfaces and having two symmetry planes at which intersection a longitudinal axis Z is located; and at least a feed arranged between the main reflector and the sub-reflector with the capacity of illuminating, first, the sub-reflector and then, through it, the main reflector to allow for a plane wave-front, wherein the common focuses of the nonaxisymmetric curvilinear surfaces of the main reflector and the sub-reflector in all sections pass through the longitudinal axis Z of the antenna, and the sub-reflector faces the main reflector in a convex shape along the longitudinal axis Z, and the generatrix of the nonaxisymmetric curvilinear surfaces of the sub-reflector is defined in spherical coordinates $r(\theta,\phi)$ as:

$$r(\theta, \varphi) = \frac{r(0.0)}{P_m(\theta, \varphi)},$$

where $P_m(\theta,\phi)$ is a polynomial of m-degree, and κ, ϕ are angles in spherical coordinates, and the relation $I=H/D_{max}$ is realized within the limits of $0.24<I<0.35$, where H is the antenna maximum size along the longitudinal axis Z, and $D_{max}$ is the maximum transverse size of the main reflector aperture.

2. The antenna of claim 1, wherein the common focuses are located at the portion $Z_0$ of the longitudinal axis Z, wherein the length of said portion is defined by the followings:

$$F_{min} \le Z_0 \le F_{max},$$

$$F_{min}/D_{max} \le Z_o/D_{max} \le F_{max}/D_{max}$$

$$0.21 \le Z_o/D_{max} \le 0.47$$

$$1 > D_{min}/D_{max} > 0.5,$$

where $Z_0$ is the portion of common focuses located along the longitudinal axis Z, $F_{min}$, $F_{max}$ are the minimum and maximum distances from the ends of the portion $Z_0$ to the main reflector along the longitudinal axis Z, and $D_{max}$ and $D_{min}$ are the maximum and minimum transverse size of the main reflector aperture.

3. The antenna of claim 2, wherein the sections of nonaxisymmetric curvilinear surfaces of the main reflector in the symmetry planes comprise parabolic curves and the sections of nonaxisymmetric curvilinear surfaces of the sub-reflector in the symmetry planes comprise hyperbolic curves.

4. The antenna of claim 2, wherein the sections of nonaxisymmetric curvilinear surfaces of the main reflector and the sub-reflector in the symmetry planes comprise aplanatic curves of the Schwarzschild's system with different focal radii.

5. The antenna of claim 2, wherein the main reflector has its edge in a projection to the plane perpendicular to the antenna longitudinal axis Z, which is in the form of an ellipse.

6. The antenna of claim 2, wherein the main reflector has its edge in a projection to the plane perpendicular to the antenna longitudinal axis Z, which is in the form of a polygon circumscribing around the ellipse.

7. The antenna of claim 2, wherein the main reflector has its edge in a projection to the plane perpendicular to the antenna longitudinal axis Z, which is in the form of an ellipse truncated by two planes parallel to a symmetry plane passing through the maximum transverse size of the main reflector aperture.

8. The antenna of claim 2, wherein the feed is made as at least one horn which axis is parallel or inclined to the antenna longitudinal axis Z, and the horn phase center is aligned with the sub-reflector focal line.

9. The antenna of claim 2, wherein the feed is made as a single assembly of at least two horns which axes are parallel to the antenna longitudinal axis Z.

10. The antenna of claim 2, wherein the feed is made of at least two horns located at a focal curve passing through the sub-reflector focus, which axes are inclined relatively to the antenna longitudinal axis Z.

11. The antenna of claim 2, wherein the feed is made of at least one horn and the horn may have a symmetrical directional beam.

12. The antenna of claim 2, wherein the feed is made of at least one horn and the horn may have an asymmetrical directional beam.

13. The antenna of claim 1, wherein the sections of nonaxisymmetric curvilinear surfaces of the main reflector in the symmetry planes comprise parabolic curves and the sections of nonaxisymmetric curvilinear surfaces of the sub-reflector in the symmetry planes comprise hyperbolic curves.

14. The antenna of claim 1, wherein the sections of nonaxisymmetric curvilinear surfaces of the main reflector and the sub-reflector in the symmetry planes comprise aplanatic curves of the Schwarzschild's system with different focal radii.

15. The antenna of claim 1, wherein the main reflector has its edge in a projection to the plane perpendicular to the antenna longitudinal axis Z, which is in the form of an ellipse.

16. The antenna of claim 1, wherein the main reflector has its edge in a projection to the plane perpendicular to the antenna longitudinal axis Z, which is in the form of a polygon circumscribing around the ellipse.

17. The antenna of claim 1, wherein the main reflector has its edge in a projection to the plane perpendicular to the antenna longitudinal axis Z, which is in the form of an ellipse truncated by two planes parallel to a symmetry plane passing through the maximum transverse size of the main reflector aperture.

18. The antenna of claim 1, wherein the feed is made as at least one horn which axis is parallel or inclined to the antenna longitudinal axis Z, and the horn phase center is aligned with the sub-reflector focal line.

19. The antenna of claim 1, wherein the feed is made as a single assembly of at least two horns which axes are parallel to the antenna longitudinal axis Z.

20. The antenna of claim 1, wherein the feed is made of at least two horns located at a focal curve passing through the sub-reflector focus, which axes are inclined relatively to the antenna longitudinal axis Z.

21. The antenna of claim 1, wherein the feed is made of at least one horn and the horn may have a symmetrical directional beam.

22. The antenna of claim 1, wherein the feed is made of at least one horn and the horn may have an asymmetrical directional beam.

* * * * *